United States Patent [19]

Sutter

[11] 4,211,450

[45] Jul. 8, 1980

[54] RELEASE MECHANISM FOR ROWS OF COLLAPSIBLE SEATS

[75] Inventor: David L. Sutter, Kennebunkport, Me.

[73] Assignee: Hussey Manufacturing Company, Inc., North Berwick, Me.

[21] Appl. No.: 27,465

[22] Filed: Apr. 5, 1979

[51] Int. Cl.[2] ..... A47C 1/12

[52] U.S. Cl. ..... 297/232; 297/331; 52/9

[58] Field of Search ..... 297/331, 232, 248, 249, 297/257, 243; 52/8, 9, 10

[56] References Cited

U.S. PATENT DOCUMENTS

| | | | |
|---|---|---|---|
| 249,558 | 11/1881 | Underhill | 297/243 |
| 775,879 | 11/1904 | Wiersching et al. | 297/232 |
| 871,624 | 11/1907 | Pitcher | 297/243 |
| 2,987,111 | 6/1961 | Walworth | 52/9 |
| 3,352,069 | 11/1967 | Curra, Jr. | 52/9 |
| 3,443,835 | 5/1969 | Brunskole | 52/9 |
| 4,155,202 | 5/1979 | Hartman | 52/9 |

*Primary Examiner*—Francis K. Zugel

[57] ABSTRACT

Apparatus is provided for setting up and collapsing long rows of seats for stadiums or auditoriums, wherein a simple camoperated release mechanism is operated from the end of each row permitting simple, convenient and rapid collapsing of rows with a minimum of personnel.

3 Claims, 5 Drawing Figures

RELEASE MECHANISM FOR ROWS OF COLLAPSIBLE SEATS

FIELD OF THE INVENTION

The present invention relates to stadium and auditorium seating in which rows of seats are mounted on platforms with the seats being collapsible onto the platforms, and the platforms being movable into a nested position as for example within a wall recess at the side of a playing field or auditorium. More particularly, the invention relates to mechanisms for locking whole rows of seats in the set up position, and for releasing the lock and collapsing the seats when storage of the seats is desired.

BACKGROUND OF THE INVENTION

Many stadiums and auditoriums are used for multiple purposes involving differing seating and floorspace demands. For example, many outdoor stadiums are used alternately for football, baseball, and track and indoor auditoriums are often used for theatrical shows; large meetings, basketball, gymnastics, ballroom dancing, etc., and the seating and space requirements for all such sports and/or activities differ radically. As a result it is highly desireable to provide roll-away seating so that space can be cleared for one activity, or extra seating provided for another.

An important aspect of changing the seating provisions of stadiums and auditoriums is the time and labor required to effect the change. For example, an afternoon football game may be followed by a night baseball game and it may be necessary to make a major change in the short period of an hour or two. To be able to do it rapidly and with a minimum of labor would be highly desireable.

Another important consideration is security of structure and safety of personnel. The seating must be readily collapsible, but it must not be so easily collapsed that the occupants can do it inadvertently during normal use.

The present invention, therefore, has as a general object, the provision of means whereby extended rows of seats may be collapsed quickly and easily with a minimum of labor. A further object is to provide such a mechanism with a substantially tamper-proof mechanism for holding extended rows of seats in the upright position, but also permitting quick and efficient release to be performed when desired.

BRIEF DESCRIPTION OF THE INVENTION

The present invention is applicable to long rows of stadium or auditory seating mounted on movable platforms. All seats within each row are mounted to pivot in unison from an upright position, set up for use, to a flat, collapsed position lying on the platform. The individual seats are laterally connected to each other to form a unitary row, and the pivotal connection between the seats and the platform is accomplished by means of a linkage and guide pin arrangement which permits the weight of the seats to hold the seats in the upright position, but which also permits the seats to be lifted and then pivoted forward to the collapsed position. Individual seats supported by such a linkage and guide pin arrangement might be lifted by a single occupant and collapsed, but long rows of 15 or more seats linked together are too heavy to be collapsed easily. The danger of such rows of seats being collapsed even by a prankster is minimal. In the present invention collapsing the row of seats is done by means of a series of cams mounted on a torsion bar. The cams are arranged to apply lifting pressure to the guide pins of the seat support mechanism so as to lift them and tilt the seats to the collapsed position. A detachable lever handle is provided to turn the torsion bar. Operation of the handle raises the guide pins of all seats in an extended row, and thereby permits a single person rapidly to collapse the entire row.

The basic feature of the invention is that the rows are relatively secure and safe in the set-up position but yet they can be quickly and conveniently collapsed with a minimum of labor.

BRIEF DESCRIPTION OF THE DRAWINGS

An illustrative embodiment of the invention is shown in the accompanying drawings in which.

DETAILED DESCRIPTION OF THE INVENTION

Figure 3:
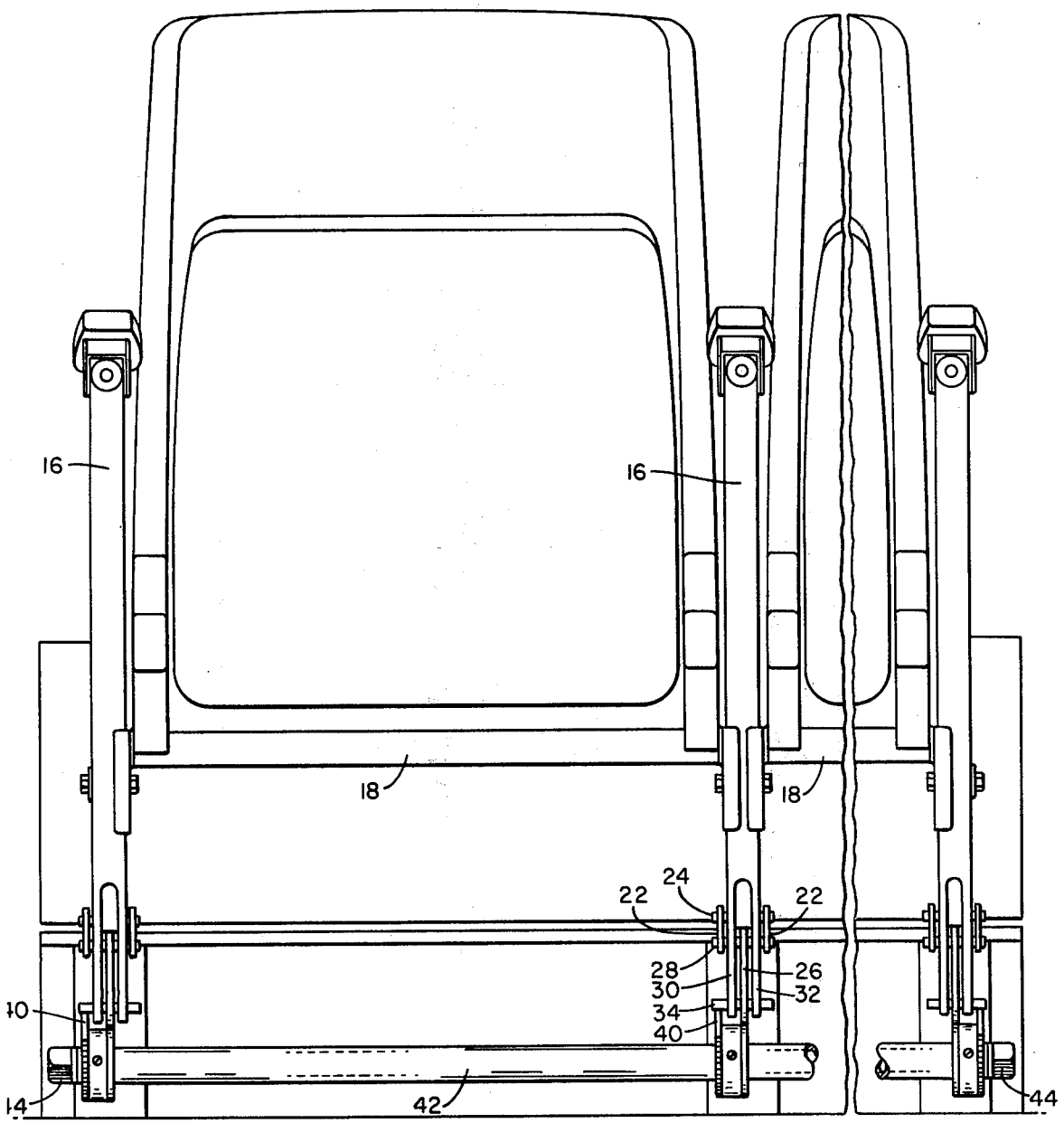
FIG. 3 is a view in front elevation, partially broken away showing a row of seats incorporating the invention.

The illustrative embodiment of the invention herein shown comprises a seat indicated generally at 10 having a back rest 12 and a pivotally mounted seat cushion 14 mounted between side stanchions 16. Stanchions 16 for each seat are interconnected by a cross brace 18 (see FIG. 3). In an extended row, seats 10 are adjoined with only one stanchion 16 between each pair of seats, cross-braces 18 of adjacent seats being both bolted to the same stanchion 16. In this way the entire row becomes a unitary structure. Although only the ends of the row and parts of three seats are shown in FIG. 3, it will be understood that the invention is useful for long rows of 15 or more seats.

Figure 1:
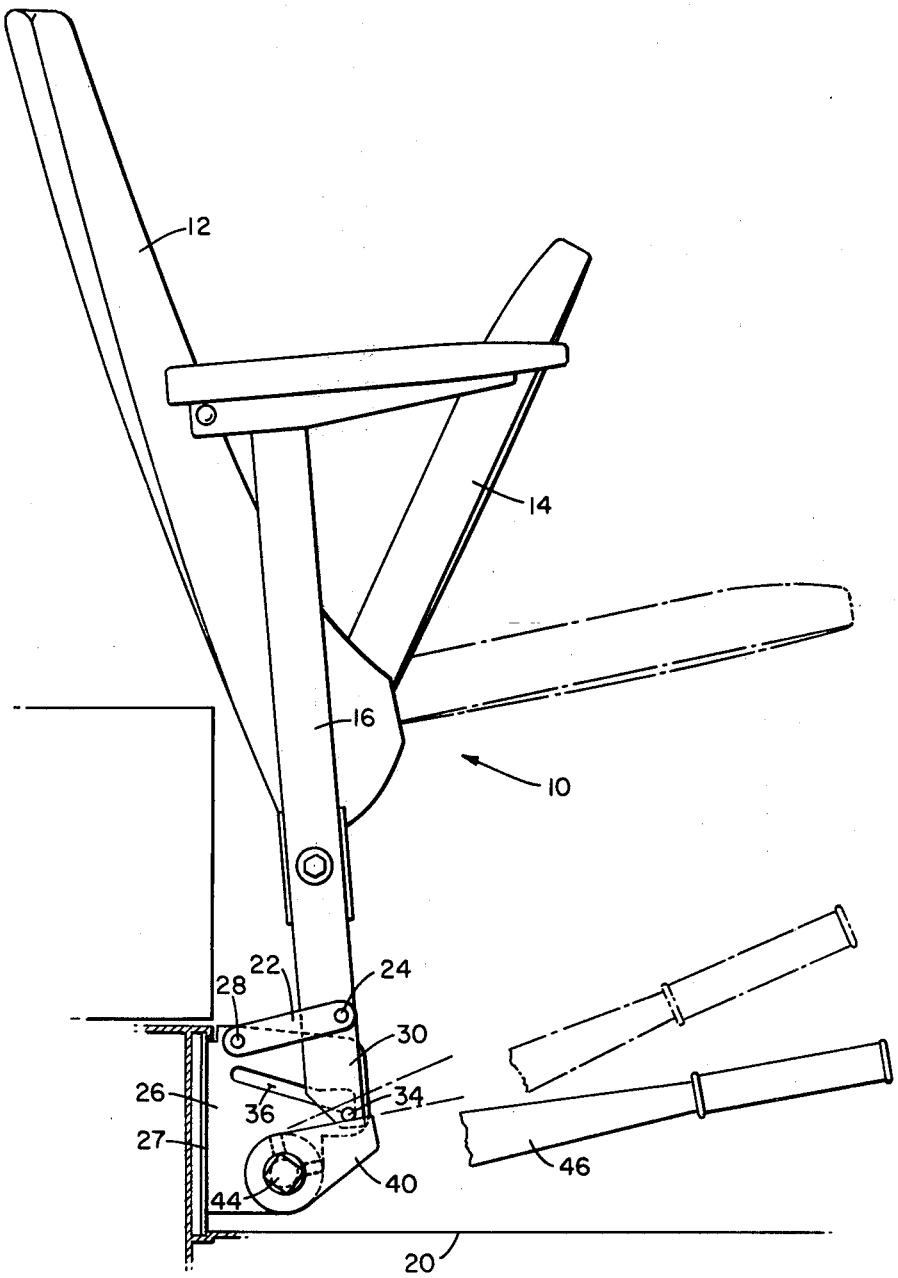
FIG. 1 is a view in side elevation of a seat incorporating the collapsible seat release mechanism of the invention, with the seat shown in the upright position.
Figure 2:
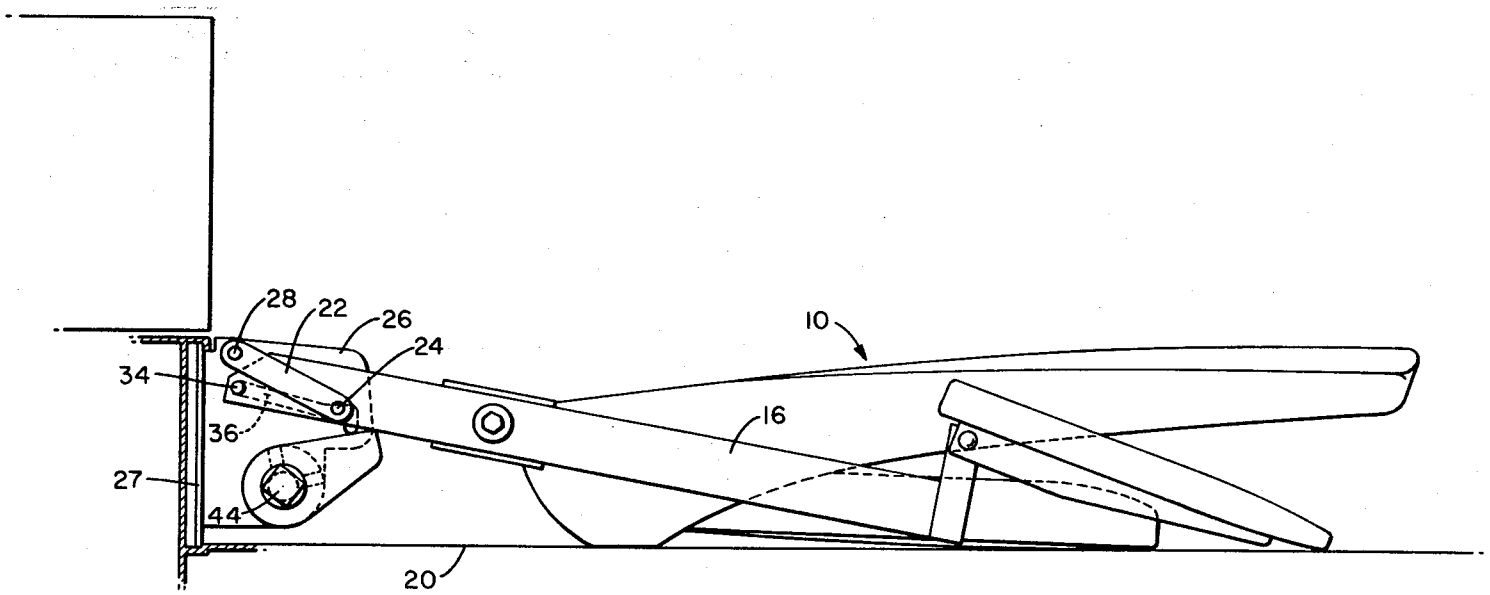
FIG. 2 is a view in side elevation of the seat of FIG. 1 shown in the collapsed position.

Seat 10 is adapted to collapse forward into a flat position parallel to platform 20 (see FIG. 2). Each stanchion 16 is pivotally connected to platform 20 by means of a pair of links 22 (pivoted to the stanchion at 24 and to a guide plate 26 at 28, the guide plate 26 being mounted on riser 27 connected to platform 20. The base of each stanchion 12 is bifurcated to form legs 30 and 32 (see FIG. 3, leg 30 only being visible in FIGS. 1 and 2). A pin 34 at the lower end of each stanchion 16 joins legs 30 and 32. Guide plate 26 lies between legs 30 and 32, and pin 34 slides in guide slot 36 (see also FIG. 4) in plate 26. With the seat 10 in the upright position shown in FIG. 1, pin 34 is at the lower, forward end of guide slot 36, where pin 34 seats in a notch 38. In this position link 22, pin 34 and notch 38 cooperate to hold stanchion 16 in a position which is fixed against motion in all directions except upward, and since the arrangement contemplates a plurality of seats 10 side by side, the weight alone of the row renders accidental or even capricious collapsing of the row highly improbable.

Figure 4:
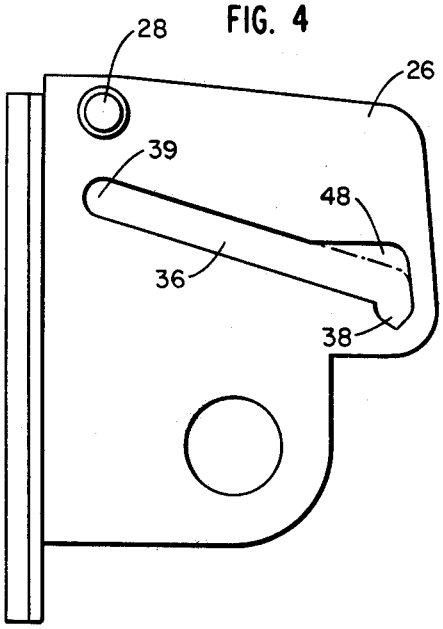
FIG. 4 is a view in side elevation of the guide plate of the invention.
Figure 5:
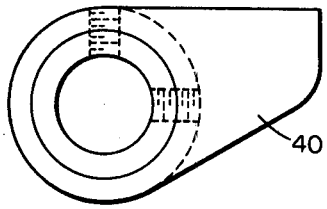
FIG. 5 is a view in side elevation of the cam of the invention.

Desired collapsing is done by lifting pins 34 out of notches 38 and tipping stanchions 16 forward so that pins 34 move along slots 36 to their rearmost extremity indicated at 39 in FIG. 4. Although the lifting of pins 34 could, theoretically, be done by several people lifting the whole row manually, it is done conveniently according to the present invention by means of cams 40 mounted on a torsion bar 42 which is journalled in plates 26 and extends the entire length of the row. Torsion bar 42 is provided with a square bolt head 44 at each end adapted to receive a lever handle 46. Rotating torsion bar 42 by means of handle 46 brings cams 40 up against pins 34 and lifts them out of notches 38 and forces them rearwardly so as to tip seats 10 forward. Since torsion bar 42 can be as long as 30 feet, the resistance of pins 34 of seats 10 toward the far end of the row (or toward the middle if the row is being collapsed from both ends simultaneously) will cause torsion bar 42 to twist to a minor degree. In order to accommodate the difference in motion of pins 34 nearest the handle end of torsion bar 42, slots 36 in guide plates 26 are notched upwardly at 48 in the vicinity above notch 38. Thus as pins 34 of the end seat 10 rise, end seat 10 will not start tipping forward until pins 34 of seats down the row also rise. This provides for a more uniform action of the release mechanism.

It will now be seen that, with the arrangement described, one man can rapidly proceed from row to row collapsing the seats and letting them drop onto platforms 20. If the rows are too long a man at each end of the row can release the seats, and both men together can break the fall of the seats onto the platform manually. In either case the operation is simple and fast. In addition, since the lever handle 46 is removed and not made available to the spectators, the risk of tampering is minimal.

Since various modifications of the preferred embodiment herein described will now be apparent to those skilled in the art, it is not intended to confine the invention to the details herein shown but rather to limit it in terms of the appended claims.

I claim:

1. Apparatus for supporting a plurality of adjoining seats in an upright position on a base and for releasing them to pivot into a collapsed position, comprising:

side stanchions for said seats, means for adjoining said seats to form an extended row;

means for pivoting said stanchions to said base comprising:

a link pivoted to each stanchion and to said base, a guide plate mounted on said base, a slot in said guide plate, a pin on the lower end of each stanchion below said link and sliding in said slot, and said link, slot, and pin arranged to guide the pivotal motion of said stanchions from an upright position to a collapsed position parallel to said base;

means for releasing said stanchions from the upright position comprising:

a torsion bar, journalled to said base running parallel to said seats in the vicinity of the lower ends of said stanchions;

a cam mounted on said bar adjacent each stanchion in position to strike and lift each said pin when the torsion bar is rotated, and means for rotating said bar.

2. The apparatus defined in claim 1 further characterized by:

a notch in said slot for restricting motion of said stanchion, when in the upright position, in all directions except upward.

3. The apparatus defined in claim 1 further characterized by:

means associated with said pin and slot for compensating for progressive twisting of said torsion bar due to the load of seats inwardly of the ends of said row.

* * * * *